US010086235B2

(12) United States Patent
Barone et al.

(10) Patent No.: US 10,086,235 B2
(45) Date of Patent: Oct. 2, 2018

(54) SWIM OR A SCUBA DIVING FIN

(71) Applicant: Mares S.p.A., Rapallo (GE) (IT)

(72) Inventors: Aristide Barone, Rapallo (IT); Marco Barbagelata, Genoa (IT)

( * ) Notice: Subject to any disclaimer, the term of this patent is extended or adjusted under 35 U.S.C. 154(b) by 0 days.

(21) Appl. No.: 15/543,774

(22) PCT Filed: Oct. 28, 2015

(86) PCT No.: PCT/IB2015/058295
§ 371 (c)(1),
(2) Date: Jul. 14, 2017

(87) PCT Pub. No.: WO2016/116785
PCT Pub. Date: Jul. 28, 2016

(65) Prior Publication Data

US 2017/0368414 A1 Dec. 28, 2017

(30) Foreign Application Priority Data

Jan. 23, 2015 (IT) ..... GE2015A0007

(51) Int. Cl.
*A63B 31/11* (2006.01)
*A43B 5/08* (2006.01)

(52) U.S. Cl.
CPC ..... *A63B 31/11* (2013.01); *A43B 5/08* (2013.01)

(58) Field of Classification Search
CPC ..... A63B 31/11; A63B 2031/112; A63B 2031/115; A63B 2031/117; A43B 5/08
See application file for complete search history.

(56) References Cited

U.S. PATENT DOCUMENTS

| | | | | |
|---|---|---|---|---|
| 3,940,815 | A * | 3/1976 | Hill | A63B 31/11 441/64 |
| 4,795,385 | A * | 1/1989 | Matsuoka | A63B 31/11 441/64 |
| 6,923,697 | B1 * | 8/2005 | Wagner | A63B 31/11 36/58.6 |
| 7,803,028 | B2 * | 9/2010 | Melius | A63B 31/11 441/64 |
| 2003/0232550 | A1 | 12/2003 | Wagner | |
| 2009/0137166 | A1 | 5/2009 | Melius | |
| 2013/0023168 | A1 | 1/2013 | Shiue | |

FOREIGN PATENT DOCUMENTS

| | | |
|---|---|---|
| FR | 2920096 | 2/2009 |
| JP | H01136673 | 5/1989 |

* cited by examiner

*Primary Examiner* — Ajay Vasudeva
(74) *Attorney, Agent, or Firm* — Themis Law

(57) ABSTRACT

A swim or scuba diving fin includes an open-back shoe portion having a pocket for receiving the foot of the user and no heel portion, a blade portion forming a forward extension of the shoe portion, and an element holding the foot in the open-back shoe portion, includes an elongate element in the form of a strap, belt or the like and a length sufficient to surround the heel portion, the sidewalls of the pocket of the shoe, and at least part of the tip of the shoe. Such elongate element is at least partially separated from the open-back shoe portion, and is or may be connected to the open-back shoe portion (3) in length-adjustable and/or at least partially removable fashion through first coupling members, which engage corresponding second coupling members located at the front tip of the open-back shoe.

13 Claims, 5 Drawing Sheets

SWIM OR A SCUBA DIVING FIN

The present invention relates to a swim or scuba diving fin, which fin comprises a shoe portion intended to receive the user foot and a blade portion forming a forward extension of the shoe portion.

Swim or scuba diving fins are divided into two basic types, the so called full-foot fins and open-heel fins.

In full-foot fins the shoe portion extends like a conventional shoe also at the heel area there being provided an upper opening for inserting the foot. The foot is inserted thanks to the elasticity of the material the shoe is made of, particularly at the upper portion. By the elasticity of the material and by the fact that generally the area of the front tip of the shoe is made as open, it is not necessary to produce a fin for each foot size, but the shoes of the fins can fit several foot sizes without affecting, for this reason, the comfort of use with the several foot sizes.

On the contrary the other type of fins provides the shoe to be opened at least in the back part since the heel portion is completely missing such to form a pocket for the foot. The foot is inserted through an opening faced towards the rear end and therefore the shoe has an analogy with footwear known as slippers. The foot is held within the pocket by means of a heel-encircling strap or element connected in a length-adjustable manner and/or possibly in a removable manner to the two opposite walls of the foot pocket. The adjustable strap generally is made of elastic material and it can be progressively secured such to block the foot within the shoe preventing it from escaping therefrom.

Open shoes can be made, at least partially, of a relatively more rigid material since it is not necessary to elastically deform them for inserting the foot. As regards fitting to the different foot sizes, even in open-heel fins it is possible to provide only one fin for a given range of different foot sizes like the full-foot fin. However in this case, the size fitting is guaranteed by the heel-encircling strap or element which is length-adjustable and has its own specific intrinsic elasticity.

Several types of heel-encircling elements and of means for the connection to the side walls of the foot pocket are known.

The patents U.S. Pat. No. 6,185,794, U.S. Pat. No. 4,795,385 and U.S. Pat. No. 5,545,067 describe a buckle for adjustably connecting at least one end of a strap to the sidewalls of the foot pocket, which strap is generally provided with a sequence of transverse teeth on one of the sides thereof. The buckle comprises a strap-guiding member, extending on the non-toothed side of the strap, transverse thereto, and around which said strap end is folded and returned, a movable strap-locking tooth extending, transverse to the strap, on the toothed side thereof, in coincidence with the strap-guiding member, and cooperating, together with counteracting elastic means, with the strap teeth, such to prevent it from freely sliding, and hand-operated strap-releasing means that allow the strap-locking tooth to be moved away from the strap such to allow it to freely slide: by such type of buckles when the user desires to wear or remove the fin it is necessary for him/her to act on the strap-releasing means for moving the movable strap-locking tooth away from the strap teeth and to loose it such to allow it to be worn, while in order to properly position the fin, that is to tighten the strap around the heel, he/she has to exert a pulling action of the free end of the strap such that the movable strap-locking tooth can cooperate with the sequence of transverse teeth provided on the strap.

The U.S. Pat. No. 4,795,385 describes a buckle composed of a fixed part, connected to the sides of the open shoe, and a releasable part that bears all the operating elements allowing the length of the strap to be adjusted and that is connectable to the fixed part by means of interlocking means: this buckle allows the fin to be quickly removed from the foot but it has the drawback of promoting the accidental loss since it allows the strap to be completely detached.

The U.S. Pat. No. 5,545,067 describes also a buckle composed of a fixed part, connected to the sides of the open shoe, and of a movable part that bears all the operating elements that allow the length of the strap to be adjusted and that is connected to the fixed part by means of a strap-tightening lever, pivoted on the fixed part and hinged to the movable part, and that can be manually overturned from a position where the strap is in a position tightened on the heel to a position where the strap is loosened: also such buckle allows the fin to be quickly removed from the foot but it has the drawback of being complicated from a constructional point of view, since it comprises a third additional part composed of the lever, and of requiring, for tightening and loosening the strap, a given space at the sides of the fin to allow the lever to be moved. Moreover it is possible for the lever to be accidentally brought in its position loosening the strap with a consequent risk of losing the fin.

The U.S. Pat. No. 6,185,794 describes a buckle composed of two parts, with a base attached to the sides of the foot pocket of a fin and comprising the movable strap-locking tooth, counteracting elastic means and manual strap-releasing means, and of a strap-fastening part comprising only the element for returning the strap and is joined to the base in a way so as to slide in the longitudinal direction between a retracted strap-tightening position wherein it is hooked to the base of the buckle and so as to be manually releasable and a forward strap-loosening position wherein the strap-guiding element is moved near the strap-locking tooth to such an extent that such tooth is disengaged from the teeth of the strap and it allows the strap to slide freely in both senses.

All the buckles described above have the advantage of allowing the strap length to be adjusted, but they protrude beyond the lateral profile of the fin since they are placed at the sides of the foot pocket and therefore they are cumbersome, aesthetically less pleasant, and they further reduce hydrodynamic properties of the fin.

The continuous use that involves operations for coupling and releasing the parts of the buckle results in a progressive deterioration and/or wear of the material with a consequent risk of breaking and losing the fin. Moreover the plastic material is subjected to aging due to salt water and to sunbeams with a consequent weakening of the parts and risk of breaking them.

According to a further type of open-shoe fin, the foot is held within the open shoe of the fin by a metal spring strap attached at the sides of the shoe or of the blade of the fin by a buckle element or the like, which strap is extensible by means of the intrinsic elasticity of the spring such to allow the foot to be placed in and removed from the shoe.

The use of the spring has the advantage of overcoming the problem of breaking the conventional strap made of an elastic material, however it has some drawbacks: the length of the spring cannot be adjusted by the user and the spring portion tends to press the heel area making the tightening of the fin on the foot less comfortable. Moreover the provision of a buckle or of an element coupling the ends of the spring provided at the sides of the shoe or of the blade and therefore protruding outwardly reduces the hydrodynamic properties of the fin.

The rigid plastic material the buckles are made of or the metal the springs are made of guarantees a higher stiffness and duration but is increases the difficulty in coupling/releasing the buckle parts or the force required for deforming the spring. Moreover in weak users such as children they can create difficulties and can prevent the fin from being worn without help.

The invention aims at overcoming the drawbacks mentioned above by providing a fin with a system for adjusting the length of the heel-encircling strap or element that is simple from a constructional point of view, less cumbersome, inexpensive, safe, long-lasting and that allows the strap to be loosened and tightened by quick and easy manual operations.

The invention relates to a swim or scuba diving fin which fin comprises an open-back shoe portion, having no heel portion, to form a pocket for receiving the foot of a user, a blade portion which forms a forward extension of the shoe portion and means for holding the foot in said open-back shoe, which foot holding means consist of an elongate element in the form of a strap, belt or the like, having such a length as to surround the heel portion, the sidewalls of the pocket of the shoe and at least part of the tip of said shoe, which elongate element is at least partially separated from said open-back shoe portion and is or may be connected to said open-back shoe portion in length-adjustable and/or at least partially removable fashion through first coupling members, which first coupling members engage with corresponding second coupling members located at the front tip of the open-back shoe.

The term strap or belt means any element with an elongate shape intended to encircle the heel and/or laterally the foot of the user and to be connected or connectable to the fin such to allow the fin to be kept worn.

It is specified that the first coupling members and the second coupling members can be made according to methods and forms known in the prior art.

According to a first embodiment said elongate element is in the form of a strap, belt or the like and it is provided, on at least one of its end portions, with a through hole or a slot or a row of multiple through holes or slots, adapted to form the first coupling members, said row being oriented in the longitudinal direction of the open-back shoe and said hole or holes being designed for coupling or engagement by elastic press-fit to/with at least one outwardly projecting coupling or engagement element which is adapted to form said second coupling members and is located at the front tip of the shoe.

Said elongate element can be made of rubber, silicone or a similar elastomeric material.

As an alternative to such arrangement it is possible to provide the elongate element in the form of a strap, belt or the like to be provided, on at least one of its two end portions, with a projecting element such as a hook or the like, or a row of projecting elements, adapted to form said first coupling members, said row being oriented in the longitudinal direction of the open-back shoe, and said projecting element or elements being designed for coupling or engagement by elastic press-fit to/with at least one hole, which is adapted to form the second coupling members and is located at the front tip of the shoe.

As it is clear from what just described the first coupling members belonging to the elongate element in the form of a belt are complementary with the second coupling members belonging to the shoe, therefore the first coupling members can be made according to one or more of the forms provided for the second coupling members and vice versa.

In particular said outwardly projecting coupling or engagement element or elements consist of at least one hook whose tip is oriented toward a transverse center plane perpendicular to a longitudinal plane that is parallel to the sole of said open-back shoe.

As an alternative or in combination said outwardly projecting coupling or engagement element or elements consist of at least one large headed pin, projecting out of the front tip of the open-back shoe, oriented substantially horizontal, i.e. parallel to the sole of said shoe and parallel or substantially parallel to a longitudinal plane perpendicular to the sole of said open-back shoe.

According to a further embodiment said at least one outwardly projecting coupling or engagement element is located in the lower or upper portion of the front tip of the shoe, below or above the plane on which the blade extends, coinciding with the tip of the sole of said open-back shoe.

Such variant allows the lateral encumbrance of the fin to be minimized as well as it allows the coupling to be brought in the point farthermost from the heel.

Preferably on the front tip of said shoe there is provided a row of hooks or pins to which at least one of the holes or slots provided on each of the two end portions of the elongate element are coupled or engaged by elastic press-fit.

Preferably the distance between a through hole or slot and the adjacent one is identical to the distance between one hook or pin and the adjacent one such that, as said elongate element is mounted on the shoe, multiple through holes or slots are coupled or engaged to/with multiple hook or pins: the elongate element therefore can be coupled and overlapped to at least a part of the front tip of the shoe in a safer and more stable manner.

The provision of several holes or slots on at least an end portion in combination with multiple hooks or pins equidistant from each other provided on the front tip of the shoe allows at least one of the end portions to be moved near or away from the tip of said shoe such to fit the fin to the length of the user foot.

In particular the portion of the elongate element intended to surround the heel can be moved near or away from the pocket intended to receive the user foot such to fit the fin to the length of the foot without using the known buckles.

The combination of at least one hole or slot and at least one hook or pin allows the fin to be quickly removed from the foot.

Moreover in comparison with the known fins provided with the strap attached to the sides of the pocket of the shoe, the positioning of said outwardly projecting coupling or engagement element or elements at the front tip of the shoe allows the coupling point of said elongate element to be moved in the point of the fin farthermost from the heel and it allows the elasticity of said elongate element to be used as much as possible, with the same modulus of elasticity of the material used in known straps, said elongate element using the maximum possible length between the point coupling to the fin and the user heel.

Unlike known fins the elongate element holding the foot in the shoe pocket is kept in place parallel along the sidewalls of the shoe by means of outer loops provided on the sidewall of the shoe pocket.

According to one embodiment said loops are two for each side of the shoe: two made of rigid plastic material and two made of soft plastic material.

Obviously it is possible to provide any number of loops made by using one or more materials known in the prior art or a combination of two or more materials known in the prior art.

Advantageously it is possible to provide at least one outer loop near the opening of the shoe pocket which loop is formed of one piece with the upper part made of a soft material having flexibility and elasticity characteristics corresponding to those of rubber or the like.

Said outer loop is connected by its upper end to the upper and by its lower end to a sole portion formed, by injection molding, overmolding or the like, on the rigid part of the sole, of the same soft material as the upper.

At least one outer loop is provided in the proximity of the front tip of said pocket, which loop is formed of one piece with the sole and part of the blade or the shoe and it is made of a rigid material having good flexibility but no extensibility, such as synthetic thermoplastic materials, e.g. polyethylene, polyurethane, polypropylene, PVC, EVA, PTE or the like.

Said loops allow the elongate element to remain very close to, adherent to, also at the sides of the shoe and therefore to the foot, completely surrounding it with the fin in the worn condition.

The foot holding means according to the present invention improve the comfort of the fin, by eliminating buckles provided at the sides of the shoe which can be not only cumbersome but also annoying for the user due to the interference with the ankle bone.

The means for holding the foot in the fin such as described in more details below, can be further simplified by using an elongate element in the form of an elastic ring such that it can be removably coupled to one or more of the outwardly projecting hooks or pins located at the front tip of the fin shoe.

Said elastic element can be an elastic element with any cross-section, for example a rounded cross-section.

It is possible to provide as the foot holding means an elastic means, such as a spring, with each one of its ends connected to means supporting a rigid slot intended to be removably coupled to one of the outwardly projecting coupling or engagement elements located on the front tip of the fin shoe.

These and other characteristics and advantages of the present invention will be more clear from the following description of some embodiments shown in the annexed drawings wherein.

Figure 1:
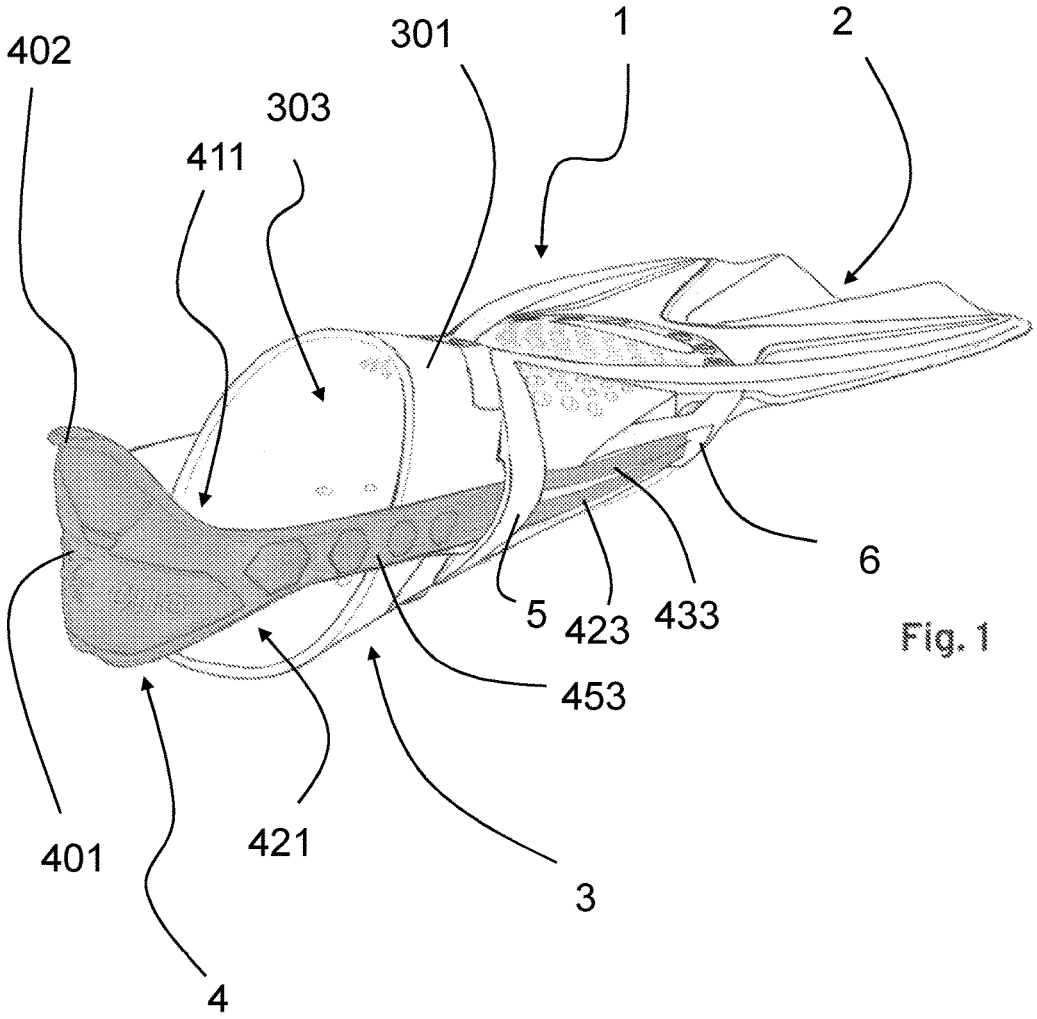
FIG. 1 is a fin according to the present invention.
Figure 2:
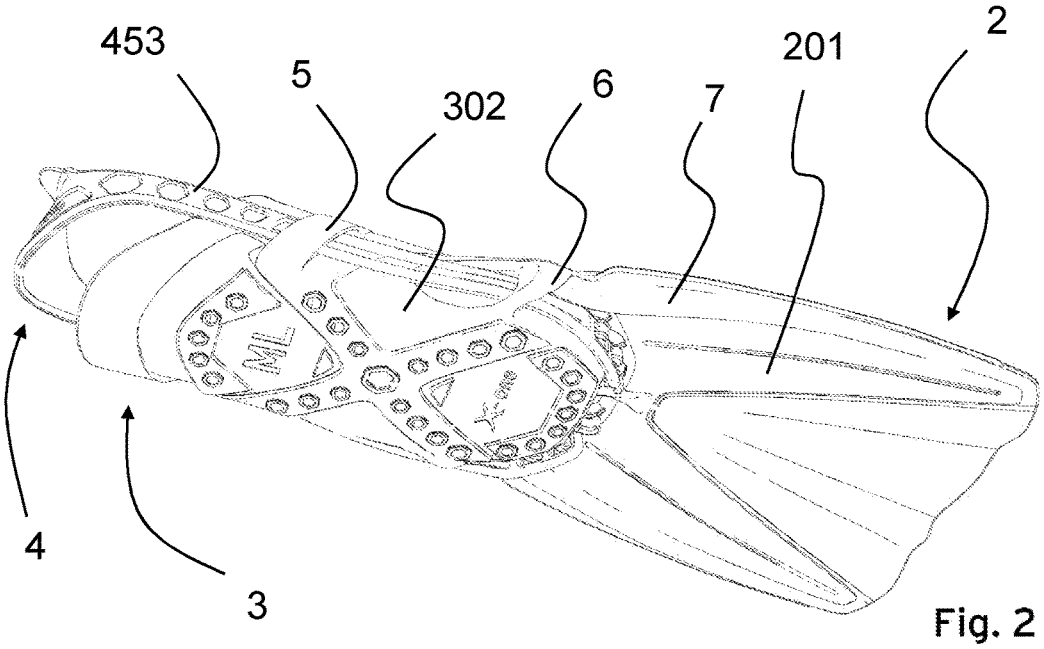
FIG. 2 is a bottom view of the fin according to the present invention.
Figure 3:
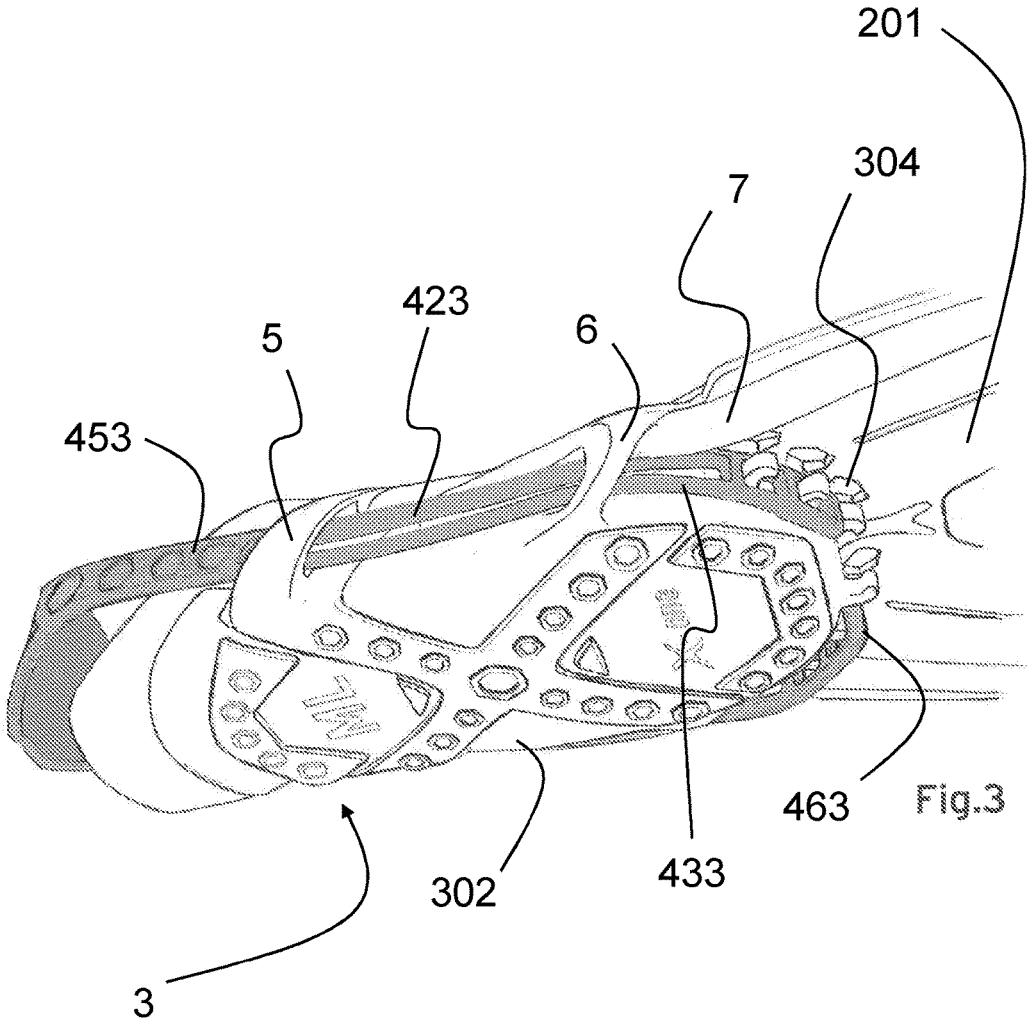
FIG. 3 is a side view of the fin shoe according to the present invention.
Figure 4:
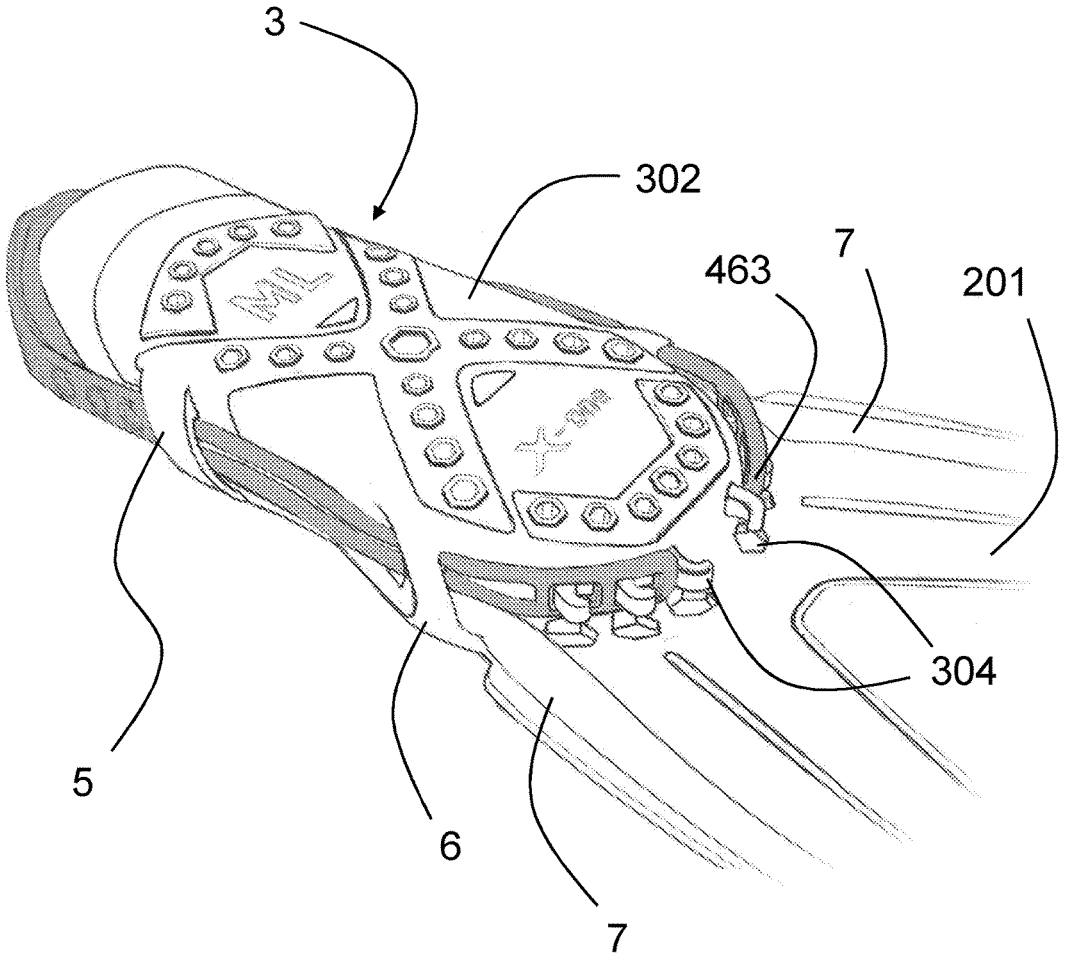
FIG. 4 is the fin shoe with the elongate element coupled to the front tip of the shoe by both the end portions.
Figure 5:
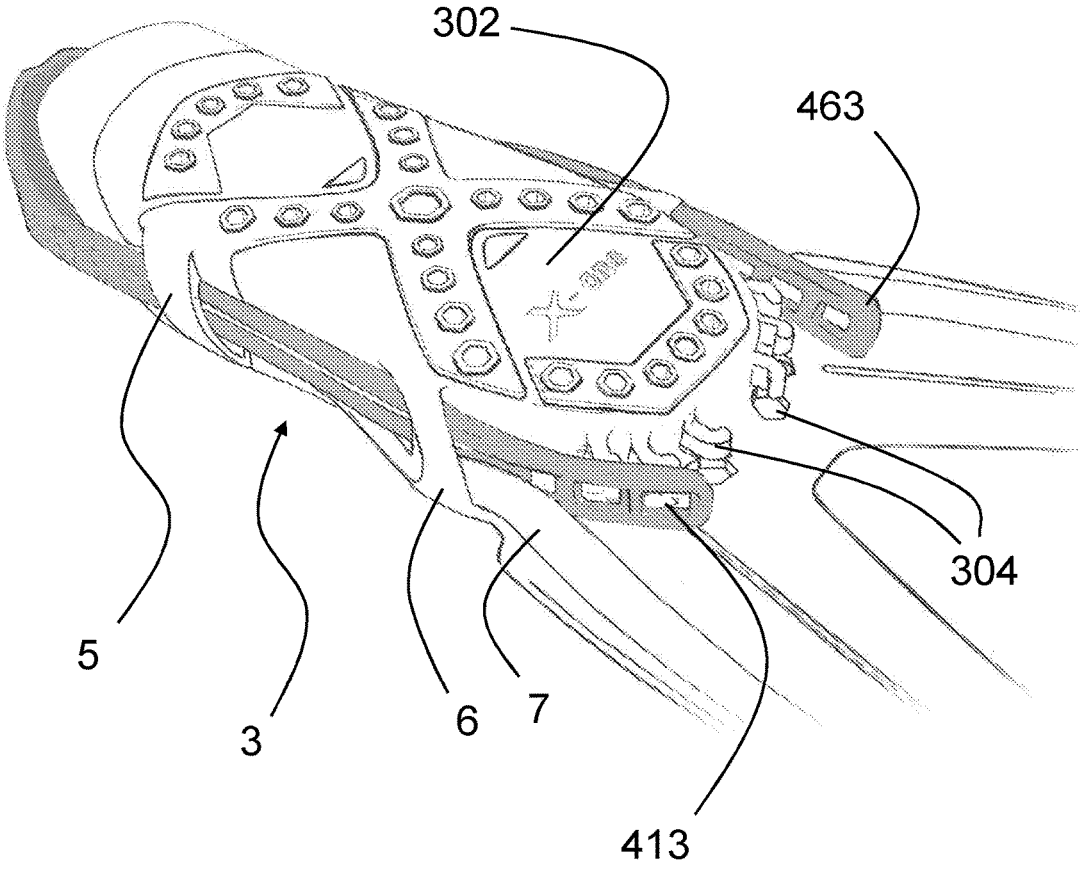
FIG. 5 is the fin shoe with the elongate element having one of its end portions released from the front tip of the shoe.

It is specified that the figures show a variant embodiment of the fin of the present invention in order to better explain the advantages and characteristics thereof.

Such variant therefore has to be considered by way of exemplification and not as a limitation to the inventive concept of the present invention With reference to the annexed drawings, 1 denotes a fin 1 comprising a blade portion 2 in the front and an open-shoe portion 3 at the back.

In the present invention the terms "back, front, upper, lower" or similar ones are referred to the fin 1 worn by the swimmer standing on the ground.

The blade 2 is formed as one piece with the front shoe portion 3 but this embodiment has not to be intended has limitative, it being possible to extend the concept of the present invention also to fins 1 wherein the blade portion 2 is removable from the shoe portion 3.

Said shoe 3 is generally made at least partially of rubber or a similar elastomeric material.

It is known that the shoe 3 comprises a sole portion 302 and an upper portion 301.

Preferably the sole portion 302 is made of an elastomeric material having a hardness and/or thickness greater than the elastomeric material the upper portion 301 is made of: the sole 302 is made of a relatively rigid material, preferably thermoplastic material, for example the same material as the blade portion 2, while the upper portion 301 is made at least partially of a soft material with flexibility and elasticity characteristics corresponding to those of rubber or the like.

The rigid material composing the blade 2 and/or the sole 302 is provided with a good flexibility but it has no extensibility such as for example synthetic thermoplastic materials e.g. polyethylene, polyurethane, polypropylene, PVC, EVA, PTE or the like, while the soft material composing the upper portion 301, or also a part of the blade 2, has a good flexibility and some extensibility, such as thermos-rubber or the like.

Generally the fin 1 is formed by injection molding or overmoulding of the flexible and elastic material on said relatively rigid material.

Said shoe 3 is open at the back since there is no heel portion, such to form a pocket 303 intended to receive the user foot that is properly kept in position within the fin 1 by heel holding means according to the present invention.

To the open-back shoe 3, having a such a length to house all the front part of the foot up to the leg, there is connected or connectable in length-adjustable and/or at least partially removable fashion an elongate element in the form of a belt, strap or the like 4 having such a length to surround the heel portion, the sidewalls of the pocket 303 of the shoe 3 and at least part of the tip of said shoe 3 such to be connected to the fin 1 through at least one projecting engagement or coupling element 304 located at the front tip of the shoe 3.

Said elongate element 4 can be composed of a belt, a strap, a string or the like.

Said elongate element 4 can be made of rubber, silicone or a similar elastomeric material.

Said element 4 on at least one of the two end portions thereof has first coupling members, which first coupling members engage with corresponding second coupling members located at the front tip of the open-back shoe 3.

With a particular reference to the figures, such coupling members are composed of removable means fastening to the front tip of the shoe 3.

Said means, denoted by 413 in the figures, are composed of a through hole or slot or a row of multiple through holes or slots 413 oriented in the longitudinal direction of the shoe 3, the hole or slot 413 being designed for coupling or engagement by elastic press-fit to/with one or more projecting coupling or engagement elements 304 provided at the front tip of the open-back shoe 3.

Said projecting coupling elements 304 are composed of at least one hook, preferably at least two hooks, each one with the tip oriented toward a transverse center plane perpendicular to a longitudinal plane that is parallel to said sole 302 of the open-back shoe 3.

According to a variant said projecting coupling elements 304 are composed of at least one large headed pin, preferably at least two large headed pins 304, that project out of the tip of the shoe 3, oriented substantially horizontal, i.e.

parallel to the sole of said shoe 3 and parallel or substantially parallel to a longitudinal plane that is perpendicular to said sole.

Like the hooks, said pins 304 are provided in the lower area of the front tip of the shoe 3, below the plane on which the blade 2 extends, coinciding with the tip of the sole 302, which sole 302 generally is more rigid and extends forwardly by the blade portion 2.

As shown in the figures one embodiment of the present invention provides several hooks or pins 304 equidistant from each other, for example six hooks or pins, considering a transverse center plane perpendicular to a longitudinal plane that is parallel to said sole, three for each side of the shoe 3, multiple through holes or slots 413 coupling or engaging thereto, they being also equidistant from each other: by shifting the through holes or slots 413 present on the elongate element 4 from the first hook or pin to the second one, extending from the center line of the front tip of the shoe 3, on both the symmetric sides of the fin 1, it is possible to increase the longitudinal extension of the area comprised between the pocket and the elongate element 4 at the user foot heel allowing a longer foot to be held within the fin 1. Said longitudinal extension can be further increased by shifting the holes or slots to the third and last hooks or pins 304.

Said elongate element 4 in the form of a strap or the like therefore is connected in a length-adjustable and/or at least partially removable fashion, through its two opposite ends, to outwardly projecting coupling members provided at the front tip of the shoe 3, said through holes or slots 413 being engageable by elastic press-fit on said pins or connectable to said hooks 304 such that said element 4 can be coupled at the front tip of the shoe 3, run parallel to the two opposite side walls of the shoe 3 and completely surround the back part of the user heel, with the fin in the worn condition.

Therefore the length adjustment of the elongate element 4 is performed by discrete steps.

Obviously it is possible to provide an end portion 463 of said elongate element 4 to be firmly secured to said shoe, while the second end portion 463 to be connectable to the front tip of the shoe 3 in a length-adjustable manner.

Said removable coupling or engagement means 413, 304 allow the length size fitting to the foot morphology.

According to one embodiment of the present invention shown in the figures said elongate element 4 is in the form of a strap and it comprises a heel-encircling portion 401 having such a shape to form, when it is mounted to the fin 1, a housing that covers at least the sides and the back of the heel portion of the foot, at least one end strap portion 463 provided with a through hole or slot or a row of multiple through holes or slots 413 oriented in the longitudinal direction of the open-back shoe 3, intended for coupling or engagement by elastic press-fit to/with said at least one outwardly projecting engagement or coupling element 304 provided at the front tip of the shoe 3, at least one of the two end strap portions 463 being connected to the edge of one of the two opposite sidewalls of the heel-encircling strap portion 401 by an extension 403 having such a length to run parallel to the sidewalls of the pocket 303 said extension 403 being at least partially composed of two opposed longitudinal branches 423, 433 spaced from each other such to delimit an empty inner area 443.

Said strap portion 401 has such a shape to form, when mounted on the fin 1, a housing that covers the sides and the back of the area of the foot heel.

It is possible to provide said portion 401 to cover also the lower part of the heel such to have the shape of the heel part of footwear or full-shoe for fins 1.

Such as shown in the figure said heel-encircling strap portion 401 has two edges, an upper one 411 and a lower one 421, symmetric to the longitudinal center axis of the elongate element 4 that surround at the sides and at the back the heel and form a housing for the swimmer heel.

Each one of the two edges 411 and 421 has a border with a curved or substantially curvilinear arrangement.

Obviously it is possible to provide two edges 411, 421 not symmetric with the longitudinal center axis of the elongate element 4 or only one edge, upper 411 or lower 421, with respect to the longitudinal center axis of the elongate element 4.

In order to make more easy to wear the fin 1 it is possible to provide a handle, a tab or the like 402 made as one piece with or fastenable to the heel-encircling strap portion 401: said handle or tab 402 makes more easy to grasp the elongate element 4 and it allows the fin 1 to be worn and removed from the user foot.

From the border of each one of the two opposite side walls of the heel-encircling strap portion 401 an extension 403 starts respectively with such a length as to run parallel to the sidewalls of the pocket 303 and fastenable by its end portion to the front tip of the shoe 3 in a removable manner by means of the complementary removable coupling or engagement means 413, 304 provided on said end portion of the extension 403 and on said front tip of the shoe 3 respectively and in an adjustable manner with respect to the front part of the open shoe and the rear heel-encircling part 401.

In the shown embodiment, the extension 403 has in its end part, in the form of a strap end portion 463, a row of through holes or slots 413 oriented in the longitudinal direction of the shoe 3, which holes or slots 413 are intended to engage by a snap-fit or to be coupled to outwardly projecting coupling or engagement elements located on the front tip of the shoe 3, such as hooks or large headed pins 304.

Thus it is possible to connect together the strap-like elongate element 4 with the front part of the open shoe by setting a predetermined distance between the heel-encircling strap portion 401 and the pocket 303 intended to receive the user foot.

This allows different lengths of the shoe 3 to be set relative to the same number of different foot lengths, making it possible to use a single fin 1 for covering different foot sizes.

The fitting to the different dimensions in the transverse direction of the foot is guaranteed by the elasticity of the material the upper portion 301 is made of.

Such as shown in the figure said extension 403 is composed of two opposed longitudinal branches 423, 433 spaced from each other that delimit an empty inner area 443. The ends of said branches are connected to the end portion provided with the complementary means 413 fastening to the front tip of the shoe 3 and to the heel-encircling strap portion 401 respectively.

According to a characteristic of the present invention said branches 423, 433 are connected to the rear heel-encircling strap portion 401 by an initial strap portion 453.

Advantageously the parts composing each elongate element 4, that is said rear heel-encircling portion 401, said initial strap portions 453, said branches 423, 433, said end strap portions 463 are formed as one piece and of the same material.

Said material can be composed of a plastic material having a given flexibility and a given extensibility such as thermos-rubber, silicone or a similar elastomeric material.

It is possible to provide the parts composing each elongate element 4 to have elasticity and/or flexibility degrees different from each other.

It is possible to provide said initial strap portions 453 and/or said branches to have a higher elasticity than the rear heel-encircling strap portion 401 and/or than said strap end portions 463 such to limit possible early damages or tears due to elastic stress of the material of the elongate element 4.

Said initial strap portions 453 can be made as corrugated, with a zig-zag pattern or like a bellows to guarantee higher elongation elasticity.

It is possible to provide at least a portion of said elongate element 4 to be composed of a metal spring.

According to one embodiment not shown said branches 423, 433 have in one or more locations distributed on their length one or more transverse bridges connecting the two opposed longitudinal branches.

It is possible to provide one or more empty spaces delimited by said bridges to be solid, for example by a material having elasticity and/or flexibility characteristics equal to or different from the material composing the opposed longitudinal branches 423, 433 and the bridges such to have an elongate element 4 with different elasticity degrees.

According to a further embodiment shown in the figures the elongate element 4 in the form of a strap, belt or the like is connectable to the two opposite sidewalls of the pocket 303 by at least one outer loop 5, 6 that extends in a transverse or inclined direction on the sidewalls of said pocket 303.

Said outer loop 5 or 6 can be made of the same material composing the upper portion 301 or of the material composing the sole 302.

Such as shown in the figure on each side wall of the pocket 303 there are provide at least two loops, an upper one 6 and a lower one 5: one near the rear opening of the pocket 303 and one near the front tip of said pocket 303, which can be opened, such as shown in the figures or closed.

Thus the elongate element 4 surrounds, by being coupled to the tip of the shoe and by being placed in contact with the sidewalls of the pocket 303 of said shoe, the foot on the sides and the swimmer heel at the back, improving the wearing of the fin 1.

Such as shown in the figures the outer loop 5 provided near the opening of the pocket 303 of the shoe 3 is formed of one piece with the shoe upper portion 301 made of a soft material, it being connected by its upper end to the upper 301 and by its lower end to a sole portion formed, by injection molding, overmolding or the like, on the rigid portion of the sole 302, of the same soft material composing the upper 301, that is a material with flexibility and elasticity characteristics corresponding to those of rubber or the like.

The outer loop 6 provided near the front tip of said pocket 303 is formed of one piece with the sole and with part of the blade 2 or of the shoe made of rigid material equipped with a good flexibility but with no extensibility, such as synthetic thermoplastic materials, such as polyethylene, polyurethane, polypropylene, PVC, EVA, PTE or the like.

Such as shown in the figure each one of said front outer loops 6 has a longitudinal member 7 forwardly extends therefrom and connected to the lower surface of the blade 2 and extending for at least a part of the length of said blade 2.

As it is clear in the figure the outwardly projecting coupling or engagement elements 304 provided on the front tip of the shoe 3 fall within the space laterally delimited by said longitudinal members 7 and on the upper side by the lower surface 201 of the blade 2: this can prevent one or both the ends of the elongate element 4 from being accidentally detached from said shoe 3, the coupling elements 4 being provided in an area of the fin not exposed to impacts when swimming or not in contact with the ground with the fin 1 in the worn condition.

According to a variant of the present invention, not shown, the elongate element 4 can be composed of a metal spring which can be coupled by its ends to the outwardly projecting coupling or engagement elements 304 through an end portion 463 composed of an eyelet, whose axis is parallel to the longitudinal or travel axis of the spring, or a fastening plate provided with a slot and intended to be engaged on said outwardly projecting coupling or engagement elements 304.

It is possible to provide the spring to be covered at least partially, preferably in the portion encircling the heel, by a tube element made of plastic material such as rubber or the like such to limit the annoyance caused by the metal spring acting on the diver's heel.

It is possible to provide said tube covering to be extended, on the side facing the swimmer heel, by one or preferably two edges, an upper and a lower one, each one with a border with a curved or substantially curvilinear arrangement, symmetric with respect to the longitudinal center axis of the spring which edges embrace, with the fin 1 in the worn condition, the side and rear region of the heel such to improve the comfort of the foot and the union of foot/shoe 3 during the fin movement.

In order to make more easier to wear the fin 1 it is possible to provide a handle, a tab or the like formed as one piece with or fastenable to the covering of the spring provided at least at the heel or at one of the two edges: said handle or tab makes more easier to grasp the elongate element 4 and it allows a force to be applied on the spring which spring, by elongating, allows the fin 1 to be worn and removed from the user foot.

It is possible to provide in combination or as an alternative to the spring an elastic element, such as a tubular elastic element with a rounded cross section.

According to a variant of the present invention, not shown, the elongate element 4 can consist of a ring element that is or may be closed on itself, which ring takes a substantially spindle-shaped configuration, once coupled to said at least one outwardly projecting coupling or engagement element located on the front tip of the shoe 3, such as a hook or a large headed pin 304, with two opposed longitudinal branches at least slightly spaced from each other, surrounding the heel portion of the swimmer and contacting the sidewalls of the pocket 303, parallel thereto.

Said ring can be composed of an elastic element, such as for example a flattened elastic element or a tubular elastic element having a rounded cross section whose ends can be tied with each other or connected to each other by means of any known means such as hooks, buckles or the like.

Variants and/or changes can be made to the fins 1 of the present invention without for this reason departing from the scope of protection claimed below.

The invention claimed is:

1. A swim or scuba diving fin (1), comprising:

an open-back shoe portion (3) having no heel portion and forming a pocket (303) for receiving a foot of a user;

a blade portion (2), which forms a forward extension of the shoe portion (3); and a foot holding system configured for holding the foot in said open-back shoe portion (3), wherein said foot holding system comprises an elongate element shaped as a strap or belt (4), having a length sufficient to surround a heel of the user, sidewalls of the pocket (303) of the shoe portion (3), and at least part of a front tip of said shoe portion (3), and wherein the elongate element (4) is at least partially separated from said open-back shoe portion (3), and is connected or connectable to said open-back shoe portion (3) in length-adjustable or at least partially removable fashion through first coupling members, which engage corresponding second coupling members located at the front tip of the open-back shoe portion (3).

2. The swim or scuba diving fin (1) as claimed in claim 1, wherein said elongate element is provided, on at least one of its two end portions, with a through hole, a slot, or a row of multiple through holes or slots (413), adapted to form said first coupling members, said through hole, slot, or row of multiple through holes or slots being oriented in a longitudinal direction of the open-back shoe portion (3) and being designed for coupling or engagement by elastic press-fit with one or more outwardly projecting coupling or engagement elements (304) which are adapted to form said second coupling members and is are located at the front tip of the shoe portion (3).

3. The swim or scuba diving fin (1) as claimed in claim 2, wherein said one or more outwardly projecting coupling or engagement elements (304) at the front tip of the open-back shoe portion (3) comprise at least one hook having a hook tip oriented toward a transverse center plane perpendicular to a longitudinal plane that is parallel to a sole (302) of said open-back shoe portion (3).

4. The swim or scuba diving fin (1) as claimed in claim 3, wherein said one or more outwardly projecting coupling or engagement elements (304) are located in a lower or upper portion of the front tip of the shoe (3), below or above a plane on which the blade portion (2) extends, and coincide with a tip of the sole (302) of said open-back shoe portion (3).

5. The swim or scuba diving fin (1) as claimed in claim 3, wherein the elongate element (4) is designed to be coupled to the two opposed sidewalls of the pocket (303) by at least one outer loop (5, 6) that extends in a transverse or inclined direction on each of the sidewalls of said pocket (303) of the shoe portion (3).

6. The swim or scuba diving fin (1) as claimed in claim 5, wherein the at least one outer loop (5) is provided near an opening of the pocket (303) of the shoe portion (3), the at least one outer loop being formed as one piece with an upper portion (301) made of a material having flexibility and elasticity characteristics of an elastomeric material, the at least one outer loop (5) being connected by an upper end to a shoe upper (301) and by a lower end to a portion of the sole (302) on a rigid portion of the sole (302), by a same material as the upper portion (301), the at least one outer loop (6) being further provided in proximity of the front tip of said pocket (303), the at least one outer loop (6) being formed as one piece with the sole and part of the blade portion (2) or the shoe portion (3) of a rigid material having flexibility but no extensibility.

7. The swim or scuba diving fin (1) as claimed in claim 5, wherein the at least one outer loop comprises a plurality of outer loops (6) located in proximity of the front tip of said pocket (303) and having a longitudinal member (7) forwardly extending therefrom and connected to a lower surface of the blade portion (2), and extending for at least part of a length of said blade portion (2), said one or more outwardly projecting coupling or engagement element (304) being located on the front tip of the open-back shoe portion (3) and falling within a space that is laterally delimited by said longitudinal members (7) and above by the lower surface (201) of the blade (2).

8. The swim or scuba diving fin (1) as claimed in claim 7, wherein said elongate element is configured as a strap or belt (4) and comprises a heel-encircling strap portion (401) shaped to form, when mounted to the swim or scuba diving fin (1), a housing that covers at least sides and back of the heel portion of the foot, at least one end strap portion (463) having a through hole, a slot, or a row of multiple through holes or slots (413) oriented in the longitudinal direction of the open-back shoe (3), designed for coupling or engagement by elastic press-fit with said one or more outwardly projecting coupling or engagement element (304) located at the front tip of the shoe portion (3), at least one end strap portion (463) being connected to an edge of one of two opposed sidewalls of the heel-encircling strap portion (401) with an extension (403) having a length that runs parallel to the sidewalls of the pocket (303), said extension (403) at least partially having two opposed longitudinal branches (423, 433), which are spaced from each other to delimit an empty inner area (443).

9. The swim or scuba diving fin (1) as claimed in claim 2, wherein said one or more outwardly projecting coupling or engagement elements (304) comprise at least one large headed pin, projecting out of the front tip of the open-back shoe portion (3), oriented substantially horizontal and parallel or substantially parallel to a longitudinal plane perpendicular to a sole (302) of said open-back shoe portion (3).

10. The swim or scuba diving fin (1) as claimed in claim 2, wherein a distance between one of the through holes or slots (413) and an adjacent one through hole or slot is identical to a distance between one of the outwardly projecting coupling or engagement elements (304) and an adjacent coupling or engagement element such that, as said elongate element (4) is mounted on the shoe portion (3), and multiple through holes or slots (413) are coupled or engaged with multiple outwardly projecting coupling or engagement elements (304).

11. The swim or scuba diving fin (1) as claimed in claim 2, wherein said elongate element (4) is a metal spring, which is coupled by its ends to said at least one outwardly projecting coupling or engagement element (304) located on the front tip of the shoe portion (3), by way of an end portion (463) having an eyelet, whose axis is parallel to the longitudinal or extension axis of the spring, or a fastening plate having a slot and designed for engagement on said at least one outwardly projecting coupling or engagement element (304).

12. The swim or scuba diving fin (1) as claimed in claim 2, wherein said elongate element (4) is a ring element that is or is configured to be closed on itself, said ring having a substantially spindle-shaped configuration, once coupled to said at least one outwardly projecting coupling or engagement element (304) located on the front tip of the shoe portion (3), with two opposed longitudinal branches, spaced from each other, surrounding the heel portion of the user and contacting the sidewalls of the pocket (303) of the open-back shoe (3), parallel thereto.

13. The swim or scuba diving fin (1) as claimed in claim 1, wherein said elongate element is provided, on at least one of its two end portions, with a projecting element or a row of projecting elements, adapted to form said first coupling members, said projecting element or row of projecting elements being oriented in a longitudinal direction of the open-back shoe portion (3) and being designed for coupling or engagement by elastic press-fit with one or more holes, which are adapted to form said second coupling members and are located at the front tip of the shoe (3).

* * * * *